US009586105B1

(12) United States Patent
Westrum et al.

(10) Patent No.: US 9,586,105 B1
(45) **Date of Patent: *Mar. 7, 2017**

(54) WEIGHTED GOLF CLUB HEAD

(71) Applicant: CALLAWAY GOLF COMPANY, Carlsbad, CA (US)

(72) Inventors: Joshua D. Westrum, San Diego, CA (US); James Justin Kuhar, San Diego, CA (US); Joseph E. Mehren, San Diego, CA (US); Chris J. Wieland, Vista, CA (US); Brooks W. Roche, Ramona, CA (US); Scott R. Manwaring, Carlsbad, CA (US); Jordan M. Greenlaw, Carlsbad, CA (US); Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 14/797,512

(22) Filed: Jul. 13, 2015

Related U.S. Application Data

(63) Continuation-in-part of application No. 14/285,479, filed on May 22, 2014, now Pat. No. 9,211,451, which is a continuation-in-part of application No. 13/797,507, filed on Mar. 12, 2013, now Pat. No. 8,900,070, which is a continuation-in-part of application No. 13/788,173, filed on Mar. 7, 2013, now Pat. No. 8,926,448, which is a continuation-in-part of application No. 13/751,447, filed on Jan. 28, 2013, now Pat. No. 8,425,346, which is a continuation of application No. 13/667,692, filed on Nov. 2, 2012, now Pat. No. 8,414,420, which is a (Continued)

(51) Int. Cl.
*A63B 53/04* (2015.01)
*A63B 53/06* (2015.01)

(52) U.S. Cl.
CPC .... *A63B 53/047* (2013.01); *A63B 2053/0408* (2013.01); *A63B 2053/0416* (2013.01); *A63B 2053/0491* (2013.01)

(58) Field of Classification Search
CPC ..... A63B 53/047; A63B 2053/0416; A63B 2053/0491; A63B 2053/0408
USPC ..... 473/324–350, 287–292
See application file for complete search history.

(56) References Cited

U.S. PATENT DOCUMENTS 5,429,353 A * 7/1995 Hoeflich ..... A63B 53/04 473/291
7,101,289 B2 * 9/2006 Gibbs ..... A63B 53/04 473/329

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having a high COR at its face center and a center of gravity located at a point close to the face and the sole is disclosed herein. In particular, the golf club head comprises a hollow body including a weight lip and face component, and the weight lip extends from the sole inside the body towards the face component without making contact with the face component. The golf club head preferably is a two-piece iron-type golf club head, and each piece is heat treated differently before being welded together to further optimize center of gravity location, ball speed, and COR distribution across the face.

12 Claims, 4 Drawing Sheets

Related U.S. Application Data continuation of application No. 13/559,279, filed on Jul. 26, 2012, now Pat. No. 8,328,661, which is a continuation of application No. 13/475,497, filed on May 18, 2012, now Pat. No. 8,257,195.

(60) Provisional application No. 61/635,363, filed on Apr. 19, 2012.

(56) References Cited

U.S. PATENT DOCUMENTS

| | | | | |
|---|---|---|---|---|
| 7,662,051 | B2 * | 2/2010 | Chen | A63B 53/047 473/342 |
| 8,257,195 | B1 * | 9/2012 | Erickson | A63B 53/0466 473/329 |
| 8,328,661 | B1 * | 12/2012 | Erickson | A63B 53/0466 473/329 |
| 8,393,976 | B2 * | 3/2013 | Soracco | A63B 53/047 473/290 |
| 8,414,420 | B1 * | 4/2013 | Erickson | A63B 53/0466 473/329 |
| 8,425,346 | B1 * | 4/2013 | Erickson | A63B 53/0466 473/329 |
| 8,475,293 | B2 * | 7/2013 | Morin | A63B 53/047 473/329 |
| 8,900,070 | B1 * | 12/2014 | Dawson | A63B 53/047 473/329 |
| 8,926,448 | B1 * | 1/2015 | Ivanova | A63B 53/047 473/329 |
| 9,211,451 | B1 * | 12/2015 | Westrum | A63B 53/047 |
| 2011/0275452 | A1 * | 11/2011 | Finn | A63B 53/047 473/331 |

* cited by examiner

WEIGHTED GOLF CLUB HEAD

CROSS REFERENCES TO RELATED APPLICATIONS

The present application is a continuation-in-part of U.S. patent application Ser. No. 14/285,479, filed on May 22, 2014, which is a continuation-in-part of U.S. patent application Ser. No. 13/797,507, filed on Mar. 12, 2013, and issued on Dec. 2, 2014, as U.S. Pat. No. 8,900,070, which is a continuation-in-part of U.S. patent application Ser. No. 13/788,173, filed on Mar. 7, 2013, and issued on Jan. 6, 2015, as U.S. Pat. No. 8,926,448, which is a continuation-in-part of U.S. patent application Ser. No. 13/751,447, filed on Jan. 28, 2013, and issued on Apr. 23, 2013, as U.S. Pat. No. 8,425,346, which is a continuation of U.S. patent application Ser. No. 13/667,692, filed on Nov. 2, 2012, and issued on Apr. 9, 2013, as U.S. Pat. No. 8,414,420, which is a continuation of U.S. patent application Ser. No. 13/559,279, filed on Jul. 26, 2012, and issued on Dec. 11, 2012, as U.S. Pat. No. 8,328,661, which is a continuation of U.S. patent application Ser. No. 13/475,497, filed on May 18, 2012, and issued on Sep. 4, 2012, as U.S. Pat. No. 8,257,195, which claims priority to U.S. Provisional Patent Application No. 61/635,363, filed on Apr. 19, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a two piece iron club head having a flexible face and internal weighting that lowers the center of gravity of the golf club head, moves the center of gravity close to the face, and stiffens the body to better support the face.

Description of the Related Art

Golfers often prefer to use irons having centers of gravity that are low and also close to the face, which increases a golfer's control over golf balls during play. Two piece irons traditionally have faces formed from 455 carpenter steel, which is not ideal because the properties of this alloy prevents manufacturers from making ultra-thin faces. In face, the face must have a thickness of above 0.080 inch for the face to provide sufficient flex, and thinning the face below 0.080 inch negatively impacts the sound made by the club at impact with a golf ball. Therefore, there is a need for two-piece iron heads having improved internal weighting and flexible, forgiving faces

BRIEF SUMMARY OF THE INVENTION

One aspect of the present invention is an iron-type golf club head comprising a body comprising a top line, a sole, a heel side, a toe side, a frontal opening, and a weight lip, and face cup comprising a striking face, an upper flange with a first length, and a lower flange with a second length, wherein the striking face comprises a face center, wherein each of the upper flange and lower flange extends rearwards away from the striking face, wherein the first length is less than the second length, wherein the weight lip is disposed proximate the frontal opening and extends towards the face component without touching any portion of the striking face, wherein the face center has a COR value that is higher than a COR value of any point directly above the face center. In some embodiments, the weight lip may extend through the frontal opening, and may not comprise any hollow regions. In other embodiments, the second length may be between 5 mm and 10 mm, the face component may be welded to the body to form a weld line, and the weight lip may extend over the weld line.

In some embodiments, the frontal opening may extend completely through the body so that the body comprises a rear opening. In other embodiments, the weight lip may comprise an upper surface and a front surface, and the upper surface may be disposed approximately perpendicular to the front surface. The thickness of the lower flange may vary, and in other embodiments, the weight lip may be welded to the body. In one embodiment, the COR at the face center may be at least 0.795, and in another embodiment, the COR at the face center may be at least 0.800. In one embodiment, the upper flange and the top line may form a complete top line when the face cup is welded to the body, and the complete top line may have a width of no less than 0.200 inch and no more than 0.375 inch, and more preferably approximately 0.300 inch.

Another aspect of the present invention is an iron-type golf club head comprising a body comprising a top line, a sole, a heel side, a toe side, and a frontal opening that extends completely through the body so that the body comprises a rear opening, a protrusion, a face cup comprising a striking face, an upper flange, and a lower flange, and a weld seam between the face cup and the body, wherein the striking face comprises a face center, wherein the protrusion is welded to the sole proximate the frontal opening and extends towards the face component without touching any portion of the striking face, wherein the face center has a COR value of at least 0.800, and wherein the COR of the face center is higher than a COR value of any point directly above the face center. In some embodiments, the thickness of the striking face may vary, the striking face may comprise an area of greatest thickness, and the area of greatest thickness may be located no more than 0.300 inch away from the lower flange. In another embodiment, the striking face may have a hardness of 28 to 44 HRC and the body may have a hardness of 30 to 36 HRC.

In some embodiments, the face cup may comprise a toe side flange extending between the upper flange and the lower flange and a heel side edge. In a further embodiment, the striking face may comprise a plurality of scorelines, and each of the plurality of scorelines may be spaced at least 0.025 inch away from the heel side edge of the face cup. In another embodiment, the weld seam may have a constant thickness. In some embodiments, the face cup may be cast from 17-4 stainless steel, and the body may be cast from 450 stainless steel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
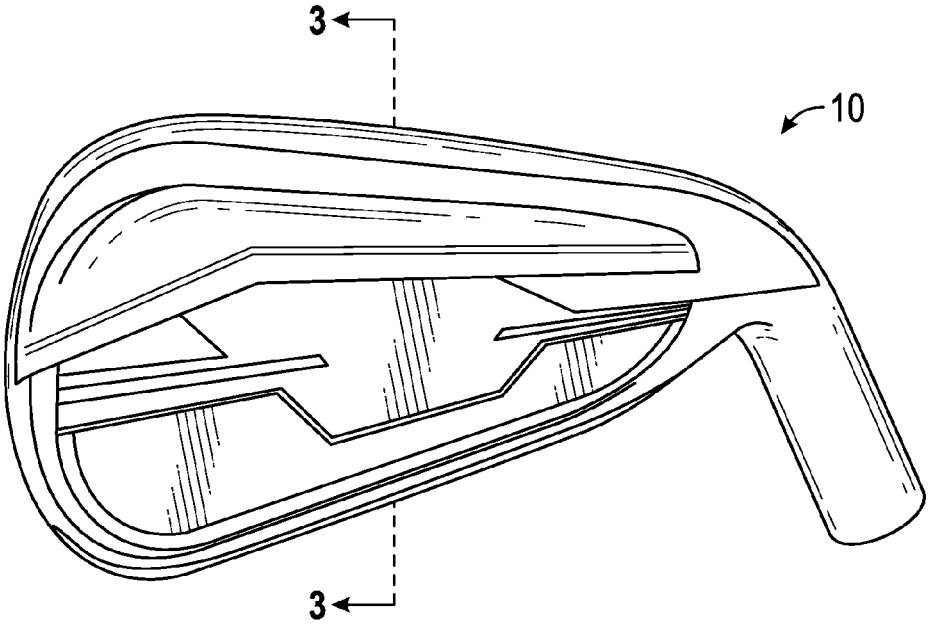
FIG. 1 is a rear elevational view of the golf club head of the present invention.

The present invention is generally directed to an iron-type golf club head having internal weighting that places the golf club center of gravity (CG) at a point near the face and the sole of the golf club head. In the preferred embodiment, the iron-type golf club head 10 comprises a partial face cup 100 and a body 200 that are welded together to form a weld seam 20, which preferably has a constant thickness, and an undercut area 290, which creates a lower center of gravity and an improvement in ball speed.

Figure 2:
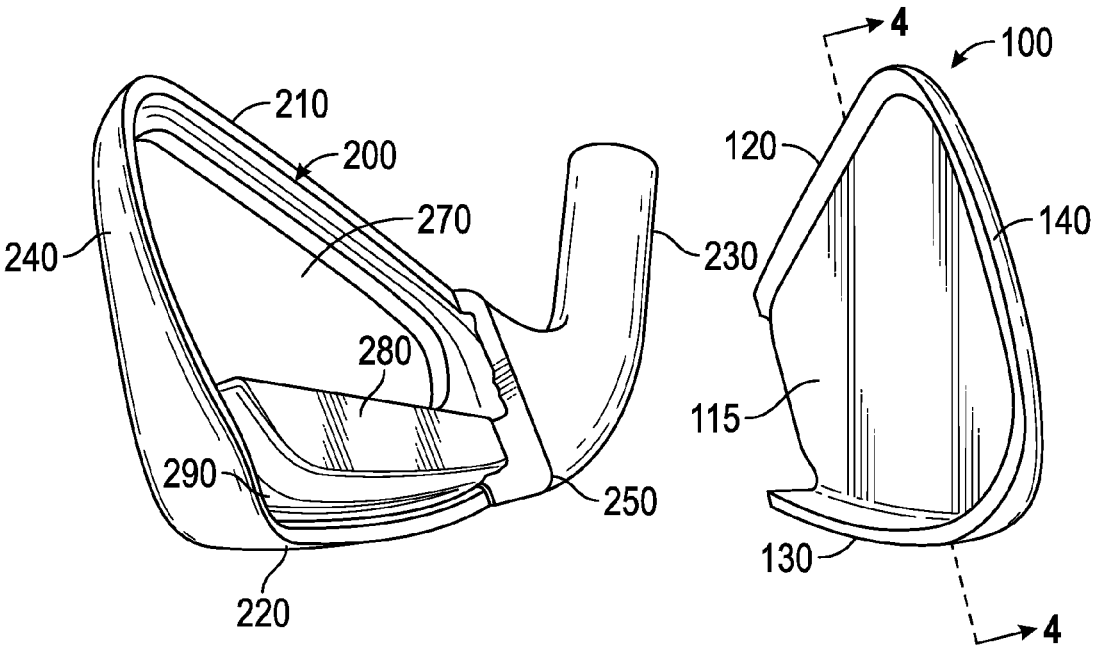
FIG. 2 is an exploded view of the golf club head shown in FIG. 1.
Figure 3:
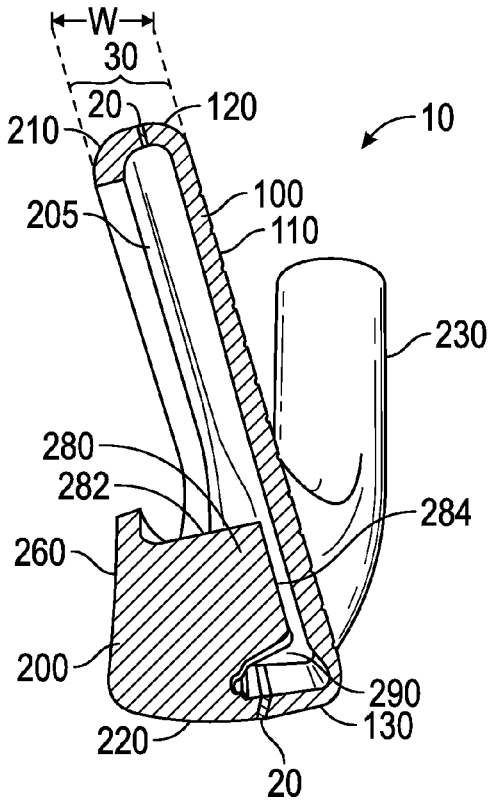
FIG. 3 is a cross-sectional view of the golf club head shown in FIG. 1 along lines 3-3.
Figure 4:
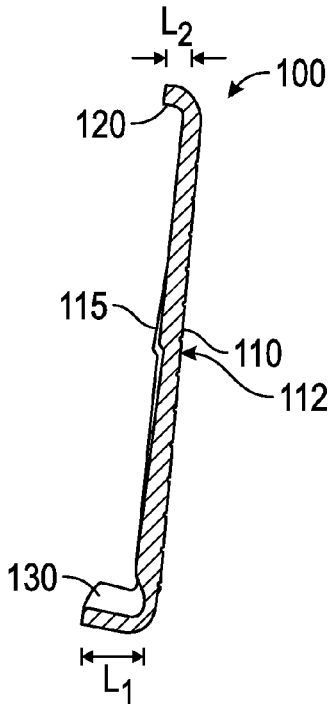
FIG. 4 is a cross-sectional view of the face cup shown in FIG. 2 along lines 4-4.
Figure 5:
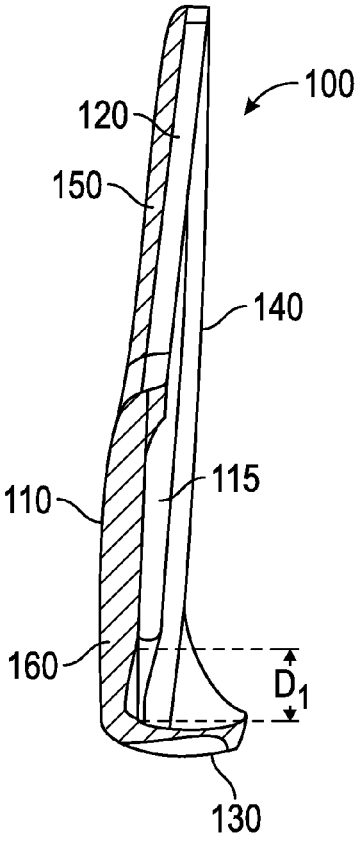
FIG. 5 is a heel side perspective view of the face cup shown in FIG. 2.
Figure 6:
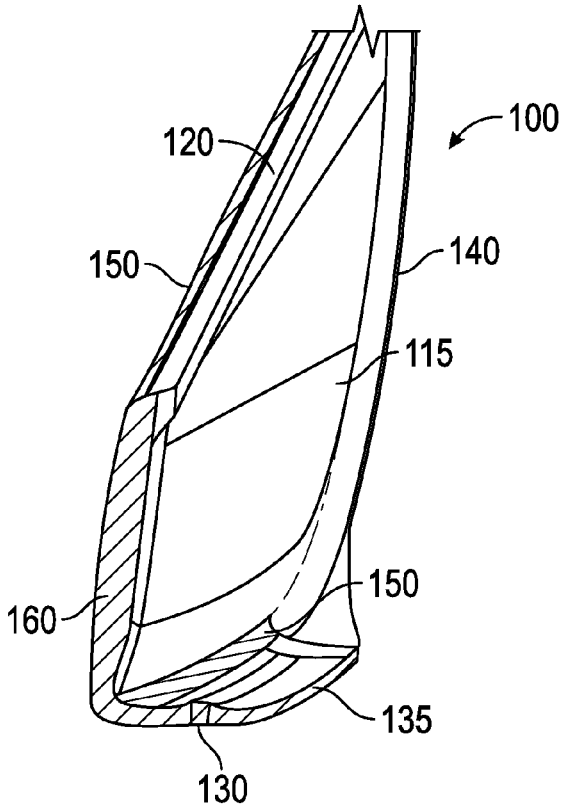
FIG. 6 is a rear perspective view of the face cup shown in FIG. 2.

As shown in FIGS. 2-6, the face cup 100 comprises a striking face 110, an upper flange 120, and a lower flange 130, which has a length $L_1$ in a front to rear direction that is longer than the length $L_2$ in a front to rear direction of the upper flange 120. Length $L_1$ preferably is between 5 and 10 mm, and more preferably is 6 to 9 mm. The thickness of lower flange 130 preferably varies as it extends away from the striking face 110, which improves the performance of the golf club head 10 and the ease with which the face cup 100 is welded to the body 200. In some embodiments, the lower flange 130 increases in thickness as it extends away from the striking face 110, thus increasing the surface area of the edge 135 where it is welded to the body 200. The face cup 100 also comprises a thin toe-side flange 140 extending between the upper flange 120 and lower flange 130, as shown in FIGS. 2, 5, and 6, but no flange along its heel side 160, where the face cup 100 is welded directly to a heel end 250 of the body 200 proximate the hosel 230. The region of the face cup 100 where the flanges 120, 130, 140 connect with the striking face 110 is the hinge 150, shown as the shaded areas of FIGS. 5 and 6.

The face cup 100 preferably constitutes about 20 to 40 percent of the total volume of the golf club head 10, and preferably is composed of a high yield, low modulus material such as 17-4 stainless steel. This material allows the striking face 110 to flex without cracking, and also allows some or all of the striking face 110 to be as thin as 0.070 inch, and the hinge 150 thickness to be as thin as 0.050-0.065 inch, while maintaining a desired sound at impact with a golf ball, preferably at 85-95 decibels and a frequency of 4000-8000 Hz, more preferably at 93 decibels and a frequency of 5000 Hz. The face cup 100 preferably is cast, which allows for the creation of different striking face 110 thicknesses, also known as variable face technology, at a much lower cost than forging, stamping or machining, though in other embodiments it may be forged to improve its strength. In the preferred embodiment, the area of the striking face 110 with the greatest thickness is located a distance $D_1$ of within 0.300 inch of the lower flange 130 as shown in FIG. 5. When the face cup 100 is cast, the scorelines 160 should originate a distance $D_2$ away from the heel side edge of the face cup 100, which preferably is approximately 0.025-0.250 inch, in order to avoid the weld seam 20 between the face cup 100 and the body 200. The upper flange 120 also preferably forms at least a part of the overall topline 30 of the golf club head 10 to improve the durability of the golf club head 10.

The body 200 preferably comprises a top line 210, a sole 220, a hosel 230, a toe end 240, a heel end 250, a rear wall 260, and a front opening 270 that extends completely through the body 200 such that the body 200 has an open back 205. The body 200 also includes a weight lip 280, which extends from the sole 220 and the rear wall 260 of the body 200 towards the front opening 270, and also extends from the heel end 250 towards the toe end 240 of the body 200. At least a portion of the weight lip 280 protrudes through the front opening 270, such that when the body 200 is assembled with the face cup 100, the weight lip 280 extends over the weld seam 20 and approaches, but does not make contact with, the rear surface 115 of the striking face 110. In some embodiments, the weight lip 280 may contact both the toe and heel ends 240, 250, but in the preferred embodiment, as shown in FIG. 2, the weight lip 280 only makes contact with the heel end 250 proximate the hosel 230. The weight lip 280 preferably has an upper surface 282 that is approximately perpendicular to its forward surface 284, but in alternative embodiments the weight lip 280 may have different dimensions and cross-sectional shapes.

The inertia of the weight lip 280 during impact of the golf club head 10 with a ball improves sole 220 compliance by enhancing the bending capabilities of thinner regions of the sole 220. The weight construction shown in the Figures also allows for the use of a face cup 100 construction without sacrificing an optimized center of gravity location, and also allows the manufacturer of the club head 10 to take weight away from, and thus thin out, the sole 220, which allows the sole 220 to flex and bend more easily and thus contribute more to performance of the face cup 100.

If the body 200 is cast, it preferably is integrally cast from a stiffer stainless steel than that of the face cup 100, such as 450 stainless steel. The weight lip 280, which contributes to stiffening the body 200 and thus supporting flexure of the face cup 100, may be integrally cast with the body 200, but doing so makes it difficult for a manufacturer to fine tune the interior dimensions of the body 200 during casting and thus lower the center of gravity as much as possible. In fact, it is difficult during the typical casting process to remove the casting shell from the undercut area 290 under the weight lip 280, and increasing the size of the undercut area 290 to make it easier to remove the casting shell only increases the height of the golf club's center of gravity. Therefore, when the body 200 is cast, it is preferable that the weight lip 280 be affixed to the body 200 via welding, soldering, brazing, or another method known to a person skilled in the art after both pieces 200, 280 are independently created.

Figure 8:
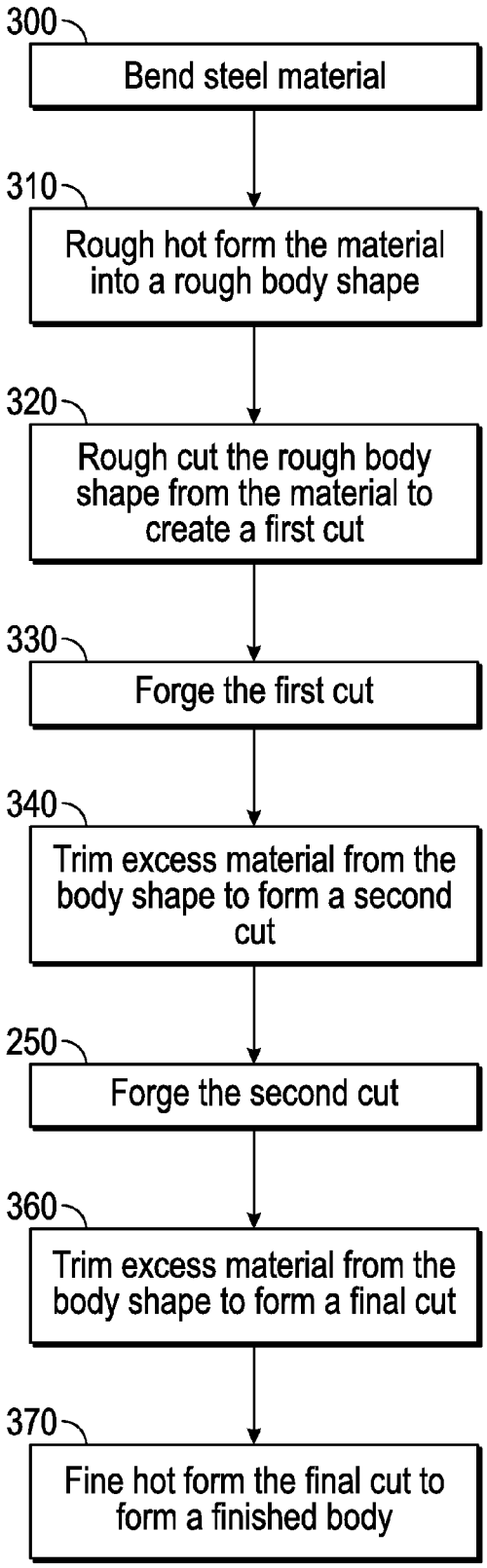
FIG. 8 is a flow chart of a preferred forging method.

In the preferred embodiment, however, the body 200 is forged from the same material as the face cup 100 (e.g., 1020, 1025, 1045 stainless steel), so that it can support the striking face 110 as it flexes and force energy transmitted to the club 10 during impact with a golf ball into flexing the striking face 110. Forging increases the stiffness of the body 200, allows the weight lip 280 to be integrally created with the body 200 instead of being added to the body 200 later, and preferably is performed using the following quadruple net forging process, which is illustrated in FIG. 8: first, a cylinder of steel material (preferably a carbon steel) is bent at a right angle 300; second, the bent steel cylinder is rough hot formed to create a rough body shape 310; third, the rough body shape is rough cut to create a first cut of the body 320; fourth, the first cut is forged 330; fifth, excess material is timed from the first cut to form a second cut 340; sixth, the second cut is forged 350; seventh, excess material is trimmed from the second cut to form a final cut 360; and finally, the final cut is hot formed to create a finished body 370. After the body 200 is finished, it is welded to the face cup 100, preferably via laser or plasma welding. In some embodiments, the face cup 100 or the body 200 may include a channel with the weld material built in, such that additional material does not need to be added to weld the parts together.

Regardless of how it is created, a stiffer body 200 provides necessary support to the face cup 100 and prevents twisting energy from creating an undesirable sound at impact. The flexibility of the face cup 100, and the stiffness of the body 200, of the two piece iron of the present invention are further optimized by heat treating these parts differently so that the face cup 100 has a hardness of 38-44 HRC on the Rockwell Scale and the body has a hardness of 30-36 HRC on the Rockwell Scale when the face cup 100 and body 200 are made from stainless steel.

Figure 7:
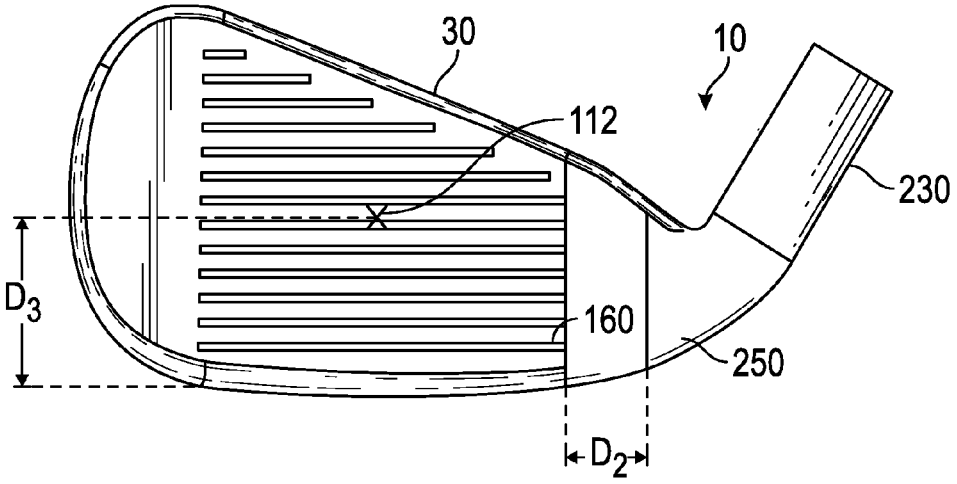
FIG. 7 is a front elevational view of the golf club head shown in FIG. 1.

The combination of the structure and heat treatment of the golf club head 10 of the present invention optimizes the coefficient of restitution ("COR") measurements of the striking face 110. COR values are measured according to USGA rules. Traditionally, cavity back irons had a highest COR measurement at a point above the center of the face due to the weakness of these irons' toplines. The iron club heads of the present invention have stiffer toplines 30, with widths W ranging from 0.200-0.375 inch, and more preferably approximately 0.300 inch, which forces the hot spot downwards across the striking face 110. These clubs 10 thus have COR measurements that are higher at the face center 112 than at any point directly above the face center 112, with COR measurements at the face center 112 of at least 0.795, and more preferably at least 0.800. As shown in FIG. 7, the face center 112 of the golf club head 10 is located a distance $D_3$ of 0.725 inch above a ground plane, measured in the vertical direction along a plane created by the striking face 110, and in the horizontal direction at the center of the area framed by the scorelines 160.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An iron-type golf club head comprising:

a body comprising a top line, a sole, a heel side, a toe side, a frontal opening, and a weight lip; and face cup comprising a striking face, an upper flange with a first length, a lower flange with a second length, and a hinge region where the upper flange and lower flange connect with the striking face, wherein the frontal opening extends completely through the body so that the body comprises a rear opening, wherein the striking face comprises a face center, wherein each of the upper flange and lower flange extends rearwards away from the striking face, wherein the hinge region has a wall thickness of 0.050 inch to 0.065 inch, wherein the first length is less than the second length, wherein the face cup is welded to the body to form a weld line, wherein the upper flange and the top line form a complete top line when the face cup is welded to the body, wherein the complete top line has a width of no less than 0.200 inch and no more than 0.375 inch, wherein the weight lip is disposed proximate the frontal opening, does not comprise any hollow regions, and extends towards the face component, over the weld line, and through the frontal opening without touching any portion of the striking face, wherein the face center has a COR value that is higher than a COR value of any point directly above the face center, and wherein the COR at the face center is at least 0.795.

2. The iron-type golf club head of claim 1, wherein the second length is between 5 mm and 10 mm.

3. The iron-type golf club head of claim 1, wherein the weight lip comprises an upper surface and a front surface, and wherein the upper surface is disposed approximately perpendicular to the front surface.

4. The iron-type golf club head of claim 1, wherein the thickness of the lower flange varies.

5. The iron-type golf club head of claim 1, wherein the weight lip is welded to the body.

6. The iron-type golf club head of claim 1, wherein the COR at the face center is at least 0.800.

7. The iron-type golf club head of claim 1, wherein the width of the complete top line is 0.300 inch.

8. An iron-type golf club head comprising:

a body comprising a top line, a sole, a heel side, a toe side, and a frontal opening that extends completely through the body so that the body comprises a rear opening;

a protrusion;

face cup comprising a striking face, an upper flange, a lower flange, and a hinge region; and a weld seam between the face cup and the body, wherein the hinge region has a wall thickness of 0.050 inch to 0.065 inch, wherein the striking face comprises a face center and varying thickness, wherein the striking face comprises an area of greatest thickness located no more than 0.300 inch away from the lower flange, wherein the protrusion is welded to the sole proximate the frontal opening and extends towards the face component without touching any portion of the striking face, wherein the striking face has a hardness of 28 to 44 HRC, wherein the body has a hardness of 30 to 36 HRC, wherein the face center has a COR value of at least 0.800, and wherein the COR of the face center is higher than a COR value of any point directly above the face center.

9. The iron-type golf club head of claim 8, wherein the face cup comprises a toe side flange extending between the upper flange and the lower flange and a heel side edge.

10. The iron-type golf club head of claim 9, wherein the striking face comprises a plurality of scorelines, and wherein each of the plurality of scorelines is spaced at least 0.025 inch away from the heel side edge of the face cup.

11. The iron-type golf club head of claim 10, wherein the weld seam has a constant thickness.

12. The iron-type golf club head of claim 8, wherein the face cup is cast from 17-4 stainless steel, and wherein the body is cast from 450 stainless steel.

* * * * *